US007903041B2

(12) United States Patent
LeVan

(10) Patent No.: US 7,903,041 B2
(45) Date of Patent: Mar. 8, 2011

(54) MAGNETIC ANTENNA APPARATUS AND METHOD FOR GENERATING A MAGNETIC FIELD

(75) Inventor: David O. LeVan, Manlius, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 331 days.

(21) Appl. No.: 12/113,538

(22) Filed: May 1, 2008

(65) Prior Publication Data

US 2009/0322640 A1 Dec. 31, 2009

(51) Int. Cl.
*H01Q 7/08* (2006.01)

(52) U.S. Cl. ..... 343/788; 343/700 MS; 343/876; 343/895

(58) Field of Classification Search ..... 343/700 MS, 343/701, 702, 705, 711, 741, 742, 743, 744, 343/753, 756, 767, 770, 786, 788, 841, 842, 343/850, 856, 860, 866, 867, 868, 872, 873, 343/876, 895; 324/202, 207.17, 225, 247, 324/252, 300, 303, 307, 309, 311, 314, 318, 324/322, 338, 339, 342, 343, 347, 355, 356, 324/366, 522, 72; 340/10.1, 10.2, 10.3, 10.33, 340/10.34, 10.4, 10.41, 10.42, 323 R, 445, 340/447, 448, 5.61, 505, 531, 539.13, 539.21, 340/551, 572.1, 572.2, 572.3, 572.4, 572.5, 340/572.6, 572.7, 572.8, 573.4, 636.1, 636.15, 340/660, 825.36, 825.49, 825.69, 825.72, 340/870.01, 870.02, 870.05, 870.17, 870.3, 340/870.31, 906

See application file for complete search history.

(56) References Cited

U.S. PATENT DOCUMENTS

| | | | | |
|---|---|---|---|---|
| 2,671,845 | A * | 3/1954 | Chromy | 219/235 |
| 4,030,032 | A | 6/1977 | Wheeler | |
| 4,517,522 | A * | 5/1985 | Furrer | 330/10 |
| 5,142,861 | A * | 9/1992 | Schlicher et al. | 60/203.1 |
| 5,771,438 | A | 6/1998 | Palermo et al. | |
| 5,912,925 | A | 6/1999 | Palermo et al. | |
| 5,982,764 | A | 11/1999 | Palermo et al. | |
| 6,061,030 | A | 5/2000 | Flowerdew | |

(Continued)

FOREIGN PATENT DOCUMENTS

EP 0830710 B1 11/2002

(Continued)

OTHER PUBLICATIONS

Yeap et al., "A Novel Common-Mode Noise Cancellation Technique for VDSL Applications", IEEE Transactions on Instrumentation and Measurement, vol. 52, No. 4, pp. 1325-1334, Aug. 2003.

(Continued)

*Primary Examiner* — Douglas W Owens
*Assistant Examiner* — Jae K Kim
(74) *Attorney, Agent, or Firm* — Howard IP Law Group, PC

(57) ABSTRACT

The present invention relates to a magnetic transmit antenna apparatus comprising: a toroidal core transformer having a primary winding inductively coupled to a secondary winding supplying a low voltage and high current to a magnetic transmit antenna wherein the magnetic transmit antenna includes a wire loop having multiple turns for generating a magnetic field. The toroidal core transformer includes a primary winding that operates in association with the secondary winding to match the impedance of a signal source to the magnetic transmit antenna.

18 Claims, 5 Drawing Sheets

U.S. PATENT DOCUMENTS

| | | | | |
|---|---|---|---|---|
| 6,263,189 | B1 | 7/2001 | Reagor | |
| 6,459,882 | B1 | 10/2002 | Palermo et al. | |
| 7,035,608 | B2 | 4/2006 | Palermo et al. | |
| 7,043,204 | B2 | 5/2006 | Reagor et al. | |
| 7,050,831 | B2 | 5/2006 | Meiksin et al. | |
| 7,142,811 | B2 | 11/2006 | Terranova et al. | |
| 7,215,924 | B2 | 5/2007 | Palermo et al. | |
| 7,236,741 | B2 | 6/2007 | Palermo et al. | |
| 7,254,366 | B2 | 8/2007 | Palermo et al. | |
| 7,719,377 | B2 * | 5/2010 | Luu et al. | 332/109 |
| 2003/0050011 | A1 | 3/2003 | Palermo et al. | |
| 2005/0143129 | A1 | 6/2005 | Funk et al. | |
| 2005/0164636 | A1 | 7/2005 | Palermo et al. | |
| 2006/0124297 | A1 | 6/2006 | Ohmer | |
| 2007/0170932 | A1 | 7/2007 | Verheijen | |
| 2009/0156157 | A1 * | 6/2009 | Rofougaran et al. | 455/334 |
| 2009/0160449 | A1 * | 6/2009 | Martinez et al. | 324/343 |

FOREIGN PATENT DOCUMENTS

| | | |
|---|---|---|
| GB | 2220823 A | 1/1990 |

OTHER PUBLICATIONS

Raab et al., "Signal Processing for Through-the-Earth Radio Communication", IEEE Transactions on Communications, vol. 43, No. 12, pp. 2995-3003, Dec. 1995.

Shyu et al., Modified FIR Filter with Phase Compensation Technique to Feedforward Active Noise Controller Design, IEEE Transactions on Industrial Electronics, vol. 47, No. 2, pp. 444-453, Apr. 2000.

International Search Report dated Jun. 30, 2009 for related application PCT/US2009/042370.

* cited by examiner

MAGNETIC ANTENNA APPARATUS AND METHOD FOR GENERATING A MAGNETIC FIELD

FIELD OF THE INVENTION

This invention relates generally to radio communications and more particularly to communications based on magnetic transmission.

BACKGROUND OF THE INVENTION

Magnetic transmit antennas are typically configured as loops of wire having a modulated current driven through them. The higher the current at the transmitted frequencies, the greater the strength of the magnetic field and, hence, the greater the transmission range of the antenna. Conventional transmit antenna designs often use a power amplifier coupled directly to the antenna, along with a tuning capacitor to cause the antenna loop to be resonant at the transmission frequency. Loop resonance is one way to increase the current and hence the magnetic field strength of the transmit antenna. However, inducing resonance in the loop antenna may undesirably generate high voltages at the resonant frequency. Such high voltages can be in the range of 1,000 to 4,000 volts, for example. These voltages can create electrical arcs that could ignite explosive gasses within the transmitter's operational environment (e.g. a coal mine) and/or cause other undesirable effects.

On the other hand, if the additional tuning circuitry is not used in conjunction with a power amplifier directly coupled to the magnetic transmit antenna so as to cause resonance within the loop antenna (and thereby increase the magnetic field strength) then a much more powerful amplifier must be used in order to provide a substantial drive current to the loop antenna for most practical applications. For example, if a loop antenna presented a load impedance of 2 ohms, and if 100 amperes of current is needed in each loop of antenna wire for a sufficient magnetic field strength for a given application, then the amplifier would be required to provide about 200 volts of drive voltage at 100 amperes (i.e. 20,000 Watts or 20 KW). Such high power amplifiers are extremely costly, heavy and generally impractical to implement in most environments. Moreover, such a high power amplifier would severely drain a portable battery, present both a large and weighty mass element, and further generate significant heat losses. Such undesirable effects tend to preclude implementation of such a structure, particularly in environments requiring portable operations. Alternative mechanisms for increasing transmission range of magnetic loop transmit antennas is desired.

SUMMARY OF THE INVENTION

The present invention relates to a magnetic transmit antenna apparatus comprising: a toroidal core transformer having a primary winding inductively coupled to a secondary winding supplying a low voltage and high current to a magnetic transmit antenna wherein the magnetic transmit antenna includes a wire loop having multiple turns for generating a magnetic field. The toroidal core transformer includes a primary winding that operates in association with the secondary winding to match the impedance of a signal source to the magnetic transmit antenna.

The invention also relates to a process for generating a magnetic field comprising supplying a high voltage, low current to a primary winding of a toroidal core transformer, inductively coupling the primary winding to a secondary winding of the toroidal core transformer for supplying a low voltage and high current to a magnetic transmit antenna, thus generating a magnetic field.

Still further, a magnetic transmit antenna apparatus for transmitting communications data comprises: a power amplifier 160 having an input 160*a* for receiving a communications data signal waveform 105*a* for transmission, and an output providing an amplified output signal waveform 105*a*' corresponding to said received communications data signal waveform; and a non-resonant toroidal core transformer driver 130 coupled between the power amplifier and a magnetic loop transmit antenna 140, the toroidal core transformer driver having a primary winding inductively coupled to a secondary winding and responsive to the output signal waveform 105*a*' from the power amplifier to supply an increased current signal waveform 107 to the magnetic loop transmit antenna, wherein the magnetic loop transmit antenna includes a wire loop having multiple turns for generating a magnetic field according to the current signal waveform from the driver to transmit the communications data.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

Figure 1:
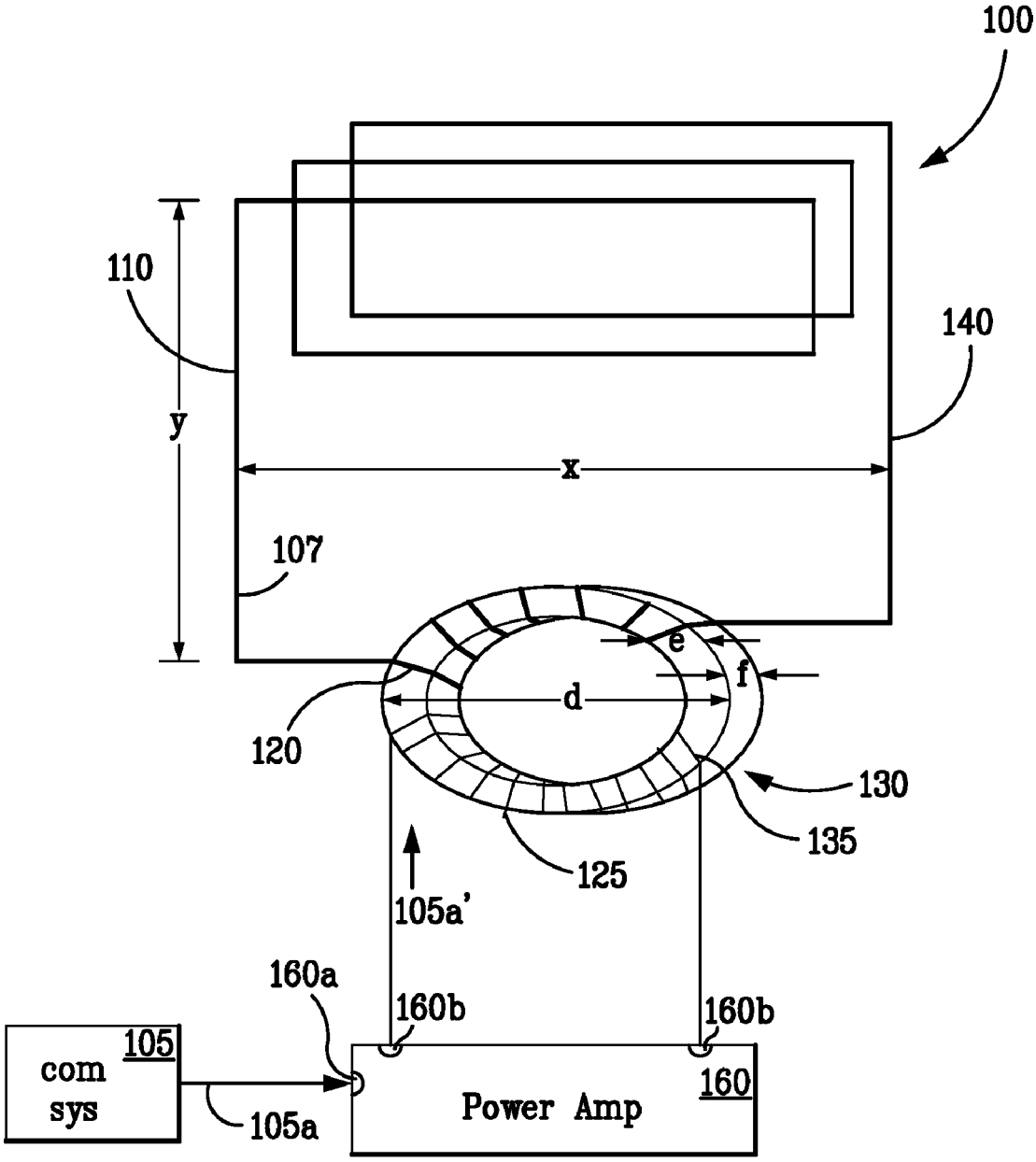
FIG. 1 illustrates a block diagram of a magnetic transmit antenna system according to an embodiment of the invention.

The following description of the preferred embodiments is merely by way of example and is in no way intended to limit the invention, its applications, or uses.

Before embarking on a detailed discussion, the following should be understood. Near-field magnetic wireless communications utilize non-propagating magnetic induction to create magnetic fields for transmitting (and receiving) as opposed to conventional radio frequency (RF) communications that create time varying electric fields. RF fields are virtually unbounded, tending to decrease in intensity as the square of the distance from the transmitting antenna, whereas magnetic fields decrease as the cube of the distance from the transmitting antenna in certain transmission media (e.g. in air or vacuum). Magnetic wireless communications generally do not suffer from the nulls and fades or interference or that often accompanies RF communications. However, conventional magnetic transmit loop antennas and their power amplifiers and tuning circuitry produce high voltages when operating at resonant frequencies. As previously described, this can cause dangerous power levels in the magnetic antenna loop, creating safety hazards.

The strength of the transmitted magnetic field is essentially dependant on the amount of current flowing in the transmit loop, rather than the voltage across the loop. The higher the current at the transmitted frequencies, the greater the strength of the magnetic field.

Current flowing in a loop antenna is the primary determinant of magnetic field strength. Magnetic moment (M) is determined as the amount of current in a loop of wire multiplied by the number of loops of wire and the cross sectional area of the loop(s) (i.e. Magnetic moment (M)=(current in a loop of wire)×(number of loops of wire)×(cross sectional area of the loop(s)). Actual total power or voltage applied is not a significant factor in transmission power.

In accordance with an aspect of the present invention, employing a transformer driver between a power amplifier and the loop of a transmit antenna provides a means to step up the current in the loop and proportionally step down the voltage, thereby keeping the power essentially constant. This enables operating the system according to an aspect of the present invention such that resonance of the loop transmit antenna is not induced, thereby allowing a broad frequency range for transmission. This is in contrast to prior art configurations that require operation at resonance, which provides only a narrow frequency range at which the transmit antenna device can function.

Moreover, the magnetic flux in a toroid is largely confined to the core, preventing its energy from being absorbed by nearby objects, making toroidal cores essentially self-shielding. Therefore, an additional feature of the toroidal transformer driver of the present invention is that it efficiently retains most of the magnetic energy in the transformer itself, thus reducing the amount of electromagnetic interference (EMI) shielding otherwise required in a application where EMI radiation must be kept to a minimum.

Referring now to the drawings, there is shown in FIG. 1 a block diagram of a magnetic transmit antenna system 100 according to an exemplary embodiment of the present invention. The system 100 generates the magnetic component of electromagnetic radiation output from loop transmit antenna 110 that conveys data communications information signals over the air for receipt via an appropriately configured receiver antenna (not shown).

As shown in FIG. 1, a magnetic transmit antenna apparatus for transmitting communications data comprises a power amplifier 160 having an input 160*a* for receiving a communications data signal waveform 105*a* for transmission, and an output 160*b* providing an amplified output signal waveform 105*a*' that corresponds to the received communications data signal waveform 105*a*. In an exemplary embodiment, input signal 105*a* may be an information carrying signal such as an audio signal such as a 0.5 v, 1 mA audio signal output from a communications source 105 such as a microphone or other such signal source operatively coupled to power amplifier 160. The communications system or source 105 includes data signals that modulate a carrier and which are conditioned as by way of example, by the application of an 802.11 paradigm (the foregoing not shown).

As further shown in FIG. 1, a non-resonant toroidal core transformer driver 130 has its primary winding 125 electrically coupled to the output 160*b* of power amplifier 160, and its secondary winding 120 electrically coupled to loop 140 of magnetic transmit antenna 110. The primary winding is inductively coupled to the secondary winding of the toroidal core transformer driver 130. The power amplifier 160 provides an output signal of the same waveform as that of the input 105*a* but with increased power characteristics. For example, for a 0.5 v, 1 mA input signal 105*a*, the output from power amplifier 160 to transformer coil driver 130 is a 10 v, 5A signal having increased power relative to the input signal 105*a* but of the same waveform.

The toroidal core 130 transformer driver primary and secondary windings are configured such that for a given input voltage and current applied to the primary winding 125, amplifies the current at the output of the secondary while reducing (e.g. inverting) the voltage output at the secondary. The waveform of the signal is not changed by the non-resonant structure, however, the current input to the loop antenna is magnified while the voltage is reduced. The increased current signal 107 waveform is input to the magnetic loop transmit antenna, wherein the magnetic loop transmit antenna includes a wire loop having multiple turns for generating a magnetic field modulated according to the current signal waveform from the driver to transmit the communications data by modulating the magnetic signal output from the loop antenna.

The separation between transmit antenna 110 and an associated receiving antenna (not shown) is about one half (½) the carrier wavelength or less for near field operation.

According to an embodiment of the present invention, power amplifier signals (see FIG. 1) may take the form of audio signal for transmission via the transmit antenna 110. By way of non-limiting example, the power amplifier 160 signal source may have a center frequency between about 90 Hz and 3,000 Hz. At the upper end, signals may carry digitized voice information between transmitters and receivers. At the lower end, the signals may carry data at a rate of around 10 bits per second, which may correspond to about one alphanumeric character a second. Depending upon the distance between transmitter and receiver and the nature of the medium of transmission (e.g., air, solid material such as rock; and/or water) interposed between transmitter and receiver, an appropriate center frequency between about 90 Hz and about 3,000 Hz may be selected. At a lower end of the transmit antenna's range a nominal carrier frequency would be on the order of 90 Hz to a higher end of 6,000 Hz.

Referring again to FIG. 1, the toroidal core transformer 130 has a core 135 which operates in conjunction with primary winding 125 and secondary winding 120 to both match impedance of the antenna 110 and power amplifier 160, and to step down the voltage applied from power amplifier 160. In one embodiment of the invention the core is fabricated from multiple layers of a ferrite material, such as supplied by Magnetic Metals of Anaheim, Calif. as 1 mil number 48 alloy comprising a magnetic permeable material wound around a form until the core dimensions d, e, f are approximately 0.127 meters×0.0191 meters×0.025 meters, respectively. The toroidal core 135 is then removed from the form.

In one embodiment of the invention, the secondary 120 windings are wide strips or ribbons of copper to achieve wide core coverage with least turns for a given turns ratio in primary 125 to secondary 120. In another embodiment of the invention the primary 125 wire wraps around the entire toroidal core such that primary 125 essentially winds around the entire inside surface of the toroid so as to provide an efficient coupling between the wire and the magnetic field surrounding the wire and the toroid material itself.

In yet another embodiment of the invention the secondary 120 utilizes a wire of lower gauge (e.g., AWG 6 gauge) and the primary 125 utilizes a higher gauge (e.g., 22 gauge wire) which is wrapped around the secondary. Alternatively, the thicker secondary wire 120 may be wrapped around the outside of the primary wire 125. In one version of the embodiment the primary 125 and the secondary 120 are interleaved. In each of the aforementioned embodiments the objective is to achieve an efficient electrical coupling between the primary 125 and the secondary 120 windings.

Various combinations of primary wire and secondary wire wound around the transformer core 135 are used to achieve differing goals dependent on transmit power, and voltage and current constraints. By way of example and not limitation, in one embodiment of the invention the transformer 130 comprises a primary of 32 AWG gauge wire having 300 turns. In yet another embodiment the transformer 130 comprises a primary composed of multiple turns of AWG 22 gauge wire wound around a secondary of 4 turns of AWG 6 gauge.

Figure 2:
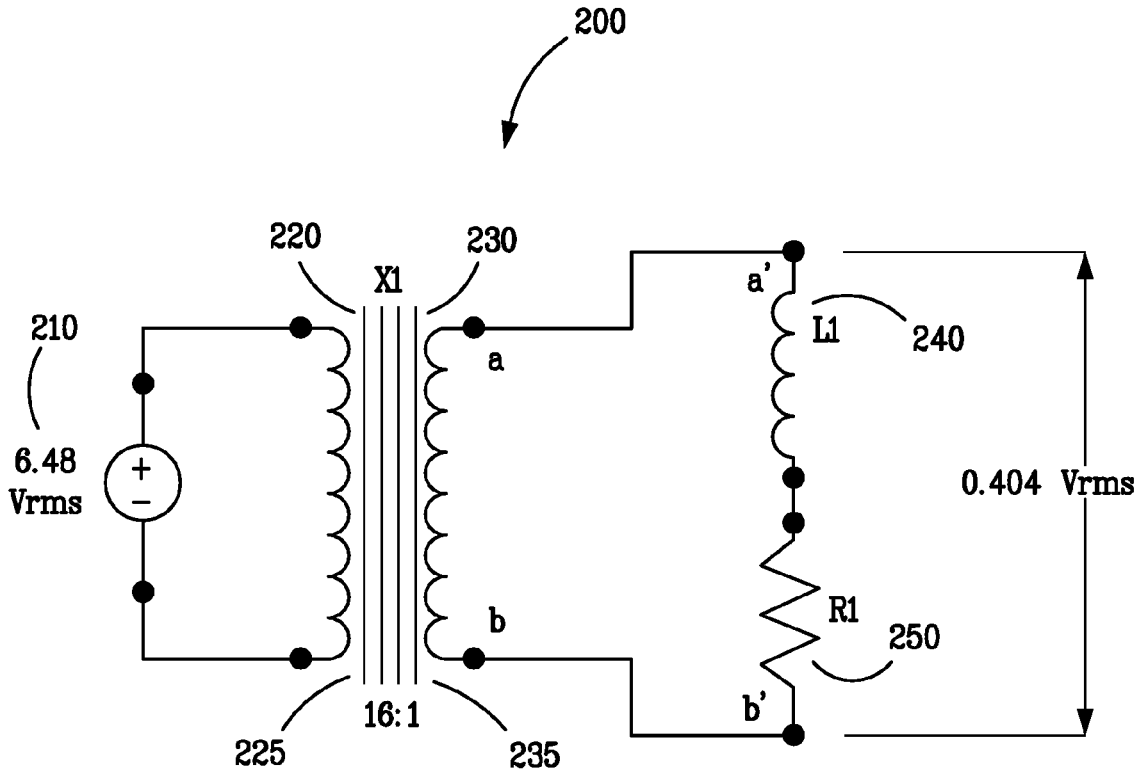
FIG. 2 illustrates a schematic circuit diagram of a magnetic transmit antenna system according to an embodiment of the invention.

Referring to the schematic circuit shown in FIG. 2, circuit 200 includes a signal source 210 such as provided by power amplifier 160 (FIG. 1), that supplies a voltage and current to toroidal core transformer 230 having a primary winding 220, a core 225 and a secondary winding 235. The secondary winding 235 poles a, b attach to respective ends a'b' of a magnetic antenna 240. Antenna 240 comprises at least one loop in the configuration shown in FIG. 1 as loop 140.

In one embodiment the primary winding 220 and the secondary winding 235 are wound with AWG 22 gauge copper magnetic wire which is lacquered for insulation. The use of AWG 22 gauge wire for the secondary winding 235 limits the current to less than 20 amps due to wire heating and for certain applications is a lower size limit for the wire employed for the toroid core transformer 230 secondary. The size wire also determines the equivalent circuit resistance looking back from the transmit antenna 110 into the secondary winding 235. The antenna 240 presents to the secondary winding 235 an equivalent circuit 250 comprising a resistor R1 in series with an inductor L1. In one embodiment the input voltage to the primary 220 is 6.48 volts RMS and the ratio of primary windings 220 to secondary windings 235 is 16:1, such that the secondary voltage is less than approximately 0.4 volts passing a current of 54.8 amps through the antenna 240.

Figure 3:
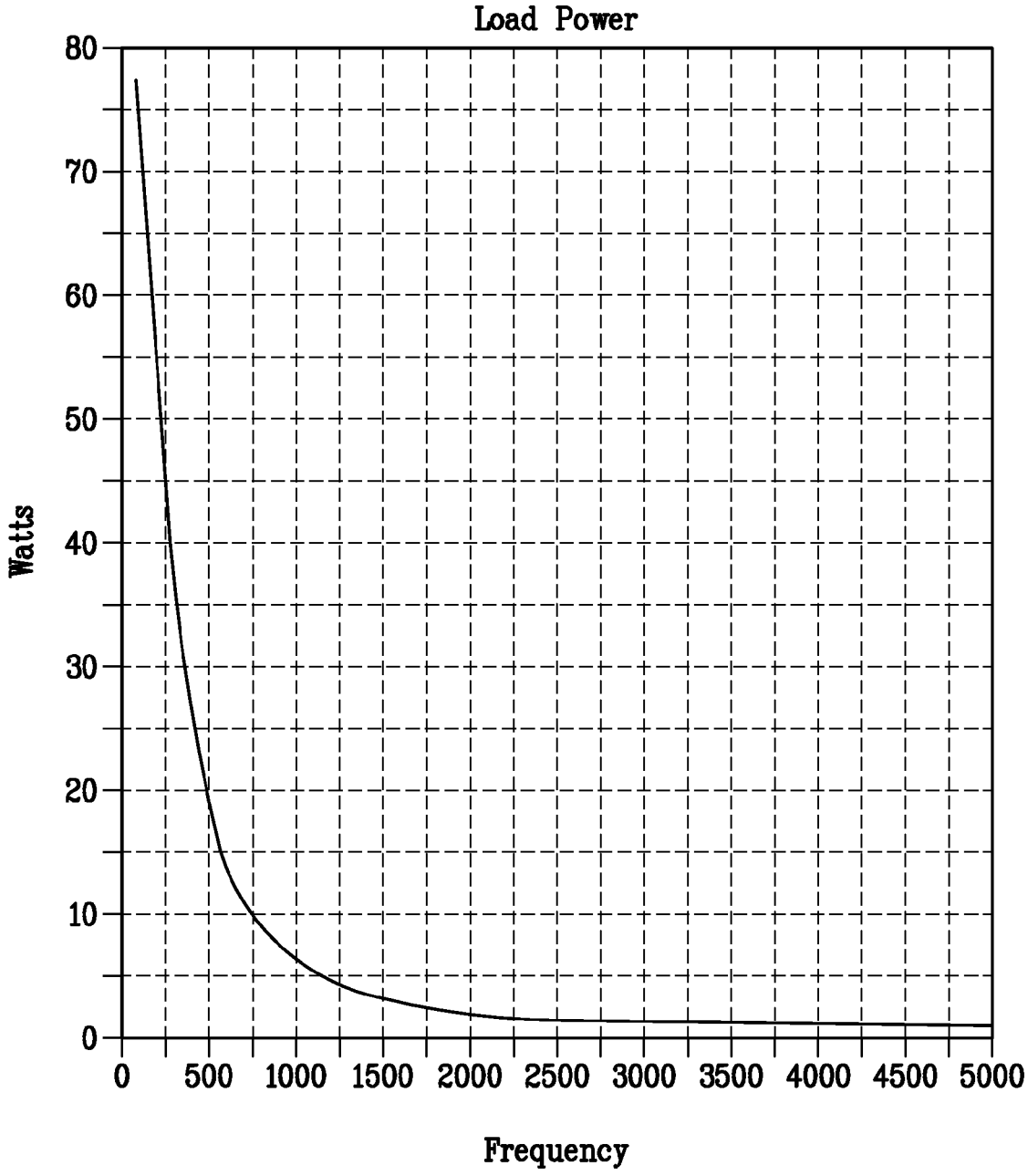
FIGS. 3 and 4 illustrate graphical representations of selected operational characteristics of a magnetic transmit antenna system according to an embodiment of the invention.

FIG. 3 shows a graph of the transmitted power as a function of frequency for the circuit parameters depicted in FIG. 2. As the frequency of the signal source 210 increases the output circuit reactance increases, which decreases current flow and in turn decreases transmit power. Under the circuit conditions illustrated in FIG. 2, a frequency of transmission of approximately 90 Hz produces a current of 200 amps in the secondary winding 235 and a voltage across the antenna of 0.404 Vrms, which combined deliver approximately 80 watts of output power. As the frequency of the source 210 is increased the power drops off as the current through the secondary winding 235 decreases. At 5,000 HZ the power has dropped to 4 watts as a result of a current of 10 amps and a voltage across the antenna of 0.404 Vrms.

Figure 4:
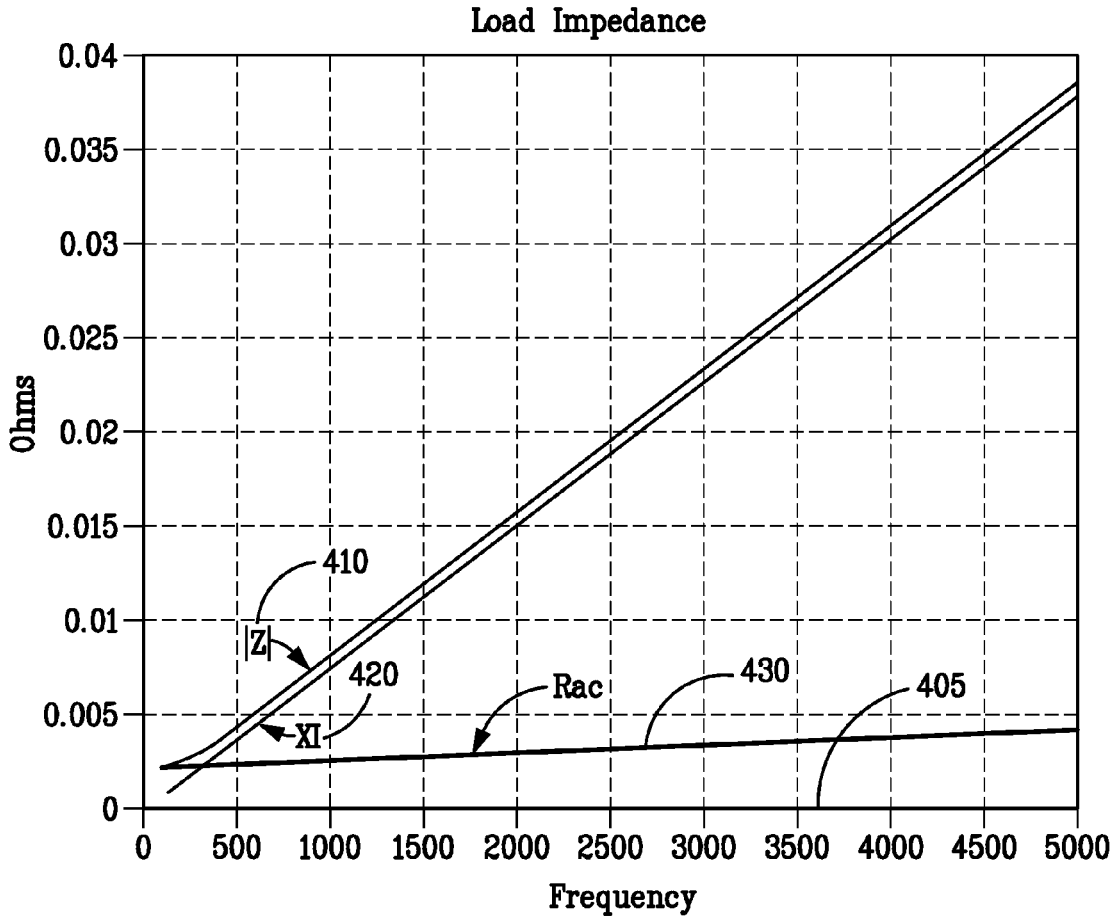

With reference to the circuit shown in FIG. 2, FIG. 4 illustrates a total impedance Z 410 of the transmit antenna 110 comprised of the additive inductor L1 impedance and R1 resistance as a function of frequency 405. Note that the reactance X1 of the transformer 230 having a core 225 tracks or matches the output impedance Z of the transmit antenna 110. Rac 430 represents the increase of effective R1 resistance as a function of frequency 405.

With reference now to FIG. 1 in conjunction with FIG. 2, the larger the cross section of the transmit antenna 110 loop 140, the greater the range. Although the invention herein describes antenna 110 having x and y dimensions in the range of substantially between 0.0125 and 0.0375 meters, there is no practical limit on the dimensions, which will depend on the application. Thus the x and y dimensions might in some applications be several meters in each direction.

Still referring to FIG. 1, the more turns of wire on loop 140 of the transmit antenna 110 the greater the transmission range. The greater the current in the loop 140 (as opposed to power) the greater the transmission range. The magnetic antenna 110 wire loop 140 may have multiple turns in the configuration of one of a square, rectangle, circle, ellipse, or triangle configuration.

One non-limiting embodiment of the antenna 110 comprises a loop 140 of 60 turns 32 gauge wire in the form of a rectangle essentially having x and y dimensions substantially between 0.0125 and 0.0375 meters in each respective dimension. The rectangular opening may have an area between 0.00016 and 0.00014 meters square. In another non limiting embodiment of the invention the loop 140 has dimensions of about 2.5 cm to 3.75 cm wide×5.0 cm high.

In an exemplary embodiment, and with reference to FIG. 2, the toroidal transformer 230 having a 200 to 1 turns ratio (primary 220 to secondary 235), could be driven by source 210 supplying 10 volts at 1 ampere (10 watts). The secondary 235 operates at 200 amps and 50 milli-volt levels, which would still be at substantially the 10 watt level.

In yet another non-limiting example, allowing for efficiency losses, loop 140 current of 90 amperes produced by 0.10 volt RMS in the secondary winding 235 requires a 10 watt source 210 as may be provided by power amplifier 160 (FIG. 1). Essentially the toroidal transformer 230 coupling provides high current to the antenna 240 at very low voltages, thereby contributing to safer operation.

Referring still to FIG. 1, according to another embodiment of the present invention, transmit antenna 110 also may have a circular configuration having a space bounded by the wire loop 140 comprising an internal round area of about 0.071 meters square. Antenna 110 may be about 0.0125 meter thick, and have approximately 3 or 4 turns, each separated by about 0.018 meter. In one embodiment, transmit antenna 110 may be composed of AWG 0000 copper wire. The antenna 110 is typically wound around an air coil. The greater the number of turns of wire on antenna 110 the greater the range between the antenna 110 and a complementary antenna such as by way of example a magnetic receiving antenna (not shown). As indicated above, other cross sectional configurations of the wire loop may be used such as a square, rectangle, circle, ellipse, or triangle.

Figure 5:
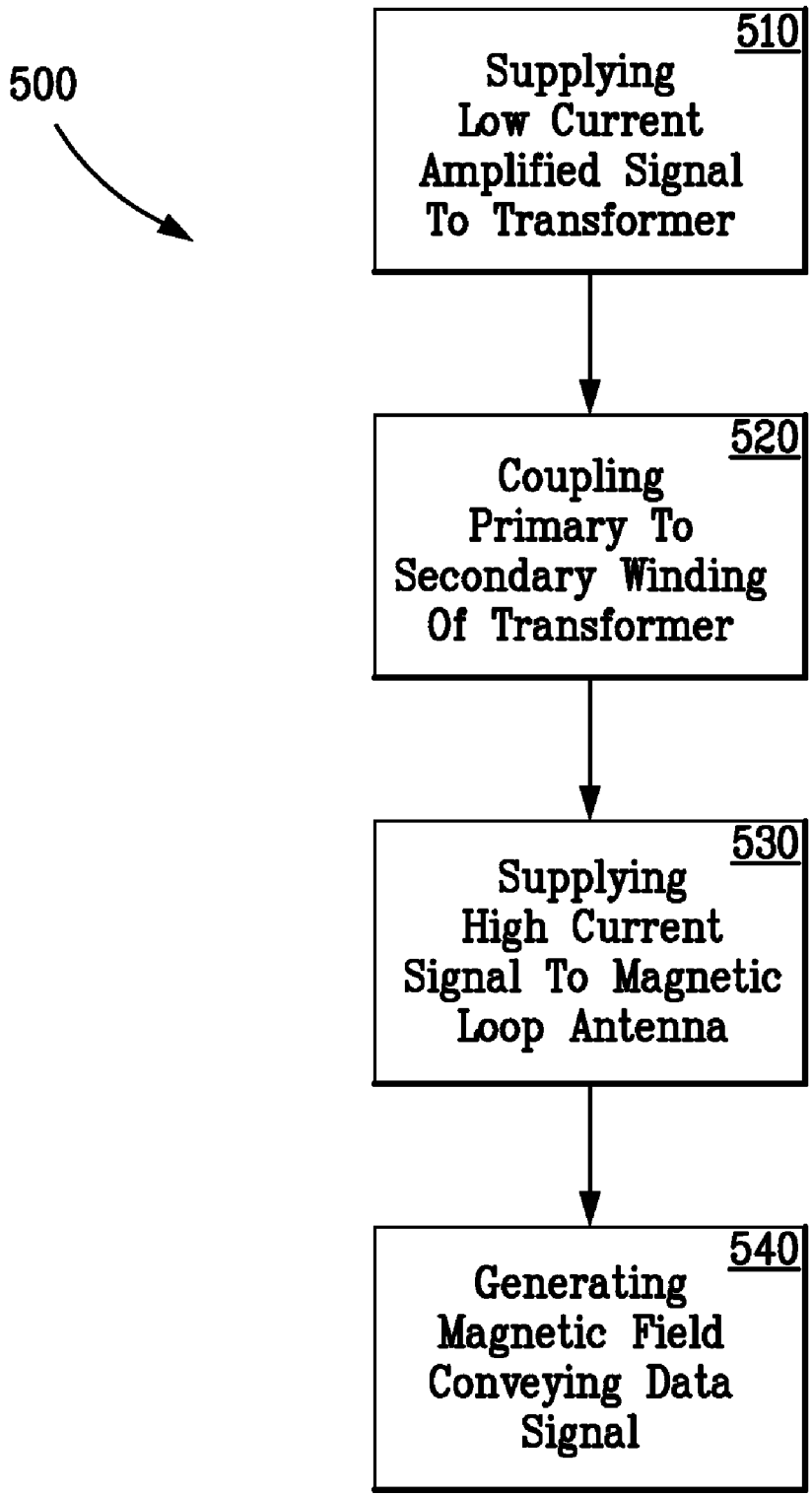
FIG. 5 illustrates a flow chart of a process for generating a magnetic field according to an embodiment of the invention.

FIG. 5 depicts an exemplary flow diagram of a process 500 for generating a magnetic field according to an aspect of the invention. The process comprises supplying 510 a high voltage low current to a primary winding of a toroidal core transformer, inductively coupling 520 the primary winding to a secondary winding of the toroidal core transformer for supplying 530 a low voltage and high current to a magnetic loop antenna, thus generating 540 a magnetic field.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A transmit antenna apparatus for transmitting magnetically communications data comprising:

a power amplifier having an input for receiving a communications data signal waveform for transmission, and an output providing an amplified output signal waveform corresponding to said received communications data signal waveform; and a non-resonant toroidal core transformer driver coupled between the power amplifier and a magnetic loop antenna, the non-resonant toroidal core transformer driver having a primary winding inductively coupled to a secondary winding and responsive to the output signal waveform from the power amplifier to supply an increased current signal waveform to the magnetic loop antenna, wherein the magnetic loop antenna includes a wire loop having multiple turns for generating a magnetic field according to said current signal waveform from said non-resonant toroidal core transformer driver to transmit said communications data.

2. The transmit antenna apparatus of claim 1, wherein the toroidal core transformer driver primary winding operates in association with the secondary winding to match the impedance of the power amplifier to the magnetic antenna.

3. The antenna apparatus of claim 1, wherein the wire loop is comprised of multiple turns of wire in one of a square, rectangular, circular, elliptical, or triangular cross sectional configuration.

4. The antenna apparatus of claim 3, wherein the wire loop has rectangular dimensions of about 0.025 meters wide×0.05 meters high.

5. The antenna apparatus of claim 1, wherein the primary winding voltage has impressed thereon a signal of substantially 6.5 volts RMS at a frequency of substantially 90 Hz, thereby producing an output current of substantially 200 amperes.

6. The antenna apparatus of claim 1, wherein the ratio of primary windings to secondary windings is a positive integer.

7. The antenna apparatus of claim 1, wherein the transmit power is a function of frequency of the signal.

8. The antenna apparatus of claim 3, wherein transmission range is a function of the cross section area of the loop.

9. The antenna apparatus of claim 1, wherein the greater the current in the loop the greater the transmission range.

10. The antenna apparatus of claim 1, wherein the secondary windings comprise ribbons of copper, thereby achieving additional core coverage with least turns for a given primary to secondary turns ratio.

11. The antenna apparatus of claim 1, wherein the primary wire winds around the entire inside surface of the toroidal core so as to provide a coupling between the wire and the magnetic field surrounding the wire and the toroidal core.

12. The antenna apparatus of claim 1, wherein the primary wire winding wraps around a secondary wire winding of lower gauge number.

13. The antenna apparatus of claim 1, wherein a thicker secondary wire is wrapped around the outside of the primary wire.

14. The antenna apparatus of claim 1, wherein the primary winding and the secondary winding are interleaved.

15. A process for generating a magnetic field for conveying a data communication signal comprising:

receiving a data communication signal;

amplifying said signal using a power amplifier to provide a high voltage low current signal waveform;

coupling a non-resonant toroidal core transformer driver between the power amplifier and a magnetic loop antenna for supplying an increased current signal waveform to the magnetic loop antenna, the non-resonant toroidal core transformer driver having a primary winding inductively coupled to a secondary winding, and generating a magnetic field according to said signal waveform from said non-resonant toroidal core transformer driver using the magnetic loop antenna, wherein the magnetic loop antenna includes a wire loop having multiple turns for generating the magnetic field.

16. The process of claim 15, wherein the step of inductively coupling the primary winding to the secondary winding comprises a non-resonant coupling.

17. The process of claim 15, wherein resonance of the antenna is not induced when generating the magnetic field.

18. The apparatus of claim 1, wherein the non-resonant toroidal transformer driver is configured to convert the amplified output signal waveform from a high voltage, low current signal waveform to a high current, low voltage signal waveform to the magnetic loop antenna.

* * * * *